US005347584A

United States Patent [19]

Narisawa

[11] Patent Number: 5,347,584

[45] Date of Patent: Sep. 13, 1994

[54] HEARING AID

[75] Inventor: Yoshiyuki Narisawa, Tokyo, Japan

[73] Assignee: Rion Kabushiki-Kaisha, Kokubunji, Japan

[21] Appl. No.: 847,934

[22] Filed: Mar. 6, 1992

[30] Foreign Application Priority Data

May 31, 1991 [JP] Japan ..... 3-048773[U]
Jun. 28, 1991 [JP] Japan ..... 3-058408[U]

[51] Int. Cl.[5] ..... H04R 25/00

[52] U.S. Cl. ..... 381/69.2; 381/68.6; 381/69

[58] Field of Search ..... 381/68, 68.6, 69.2, 381/69, 23.1; 179/107; 181/23

[56] References Cited

U.S. PATENT DOCUMENTS 2,430,229 11/1947 Kelsey ..... 381/68.6
2,959,645 11/1960 Ladd ..... 381/69.2
4,716,985 1/1988 Haertl ..... 381/69
4,870,688 9/1989 Voroba et al. ..... 381/69.2
4,987,277 1/1991 Bisgaard et al. ..... 381/69

FOREIGN PATENT DOCUMENTS 1173657 12/1969 United Kingdom ..... 381/68.6
8404016 10/1984 World Int. Prop. O. ..... 381/68

*Primary Examiner*—Curtis Kuntz
*Assistant Examiner*—Sinh Tarn
*Attorney, Agent, or Firm*—William S. Frommer; Alvin Sinderbrand

[57] ABSTRACT

A hearing aid is used to be inserted into and removed from an ear hole. A cam attached to a taking-out knob pushes up a battery holder by lifting up the taking-out knob when the hearing aid is taken out from an ear hole, whereby the electrode of the battery in the battery holder is left from the battery connecting tongues attached to a panel portion to thereby turn OFF a power supply. A howling prevention fixture is fixed to a hearing aid case at the head portion thereof to prevent howling.

8 Claims, 7 Drawing Sheets

HEARING AID

BACKGROUND OF THE INVENTION

This invention relates to a hearing aid, and more particularly to an ear insertion type hearing aid capable of being easily inserted into and removed from an ear hole.

Conventionally, as the main body of an ear insertion type hearing aid, in particular, a custom type hearing aid is in more intimate contact with an ear hole in addition to that the main body is made compact, a time-consuming job is increasingly required to insert and remove the hearing aid.

As a method of solving this problem, there has been conventionally proposed a hearing aid, as shown in FIG. 1, in which the case 2 of a hearing aide 1 is formed to adapt to the configuration of the external auditory miatus of a wearer and a U-shaped taking-out knob 5 is mounted on the surface of a panel 3 provided at the outside end of the case 2 together with components such as a gain regulator 4 with a power supply switch and the like.

The opposite ends of the taking-out knob 5 is turningly supported by a mounting hole 6 defined to the case 3 and the hearing aid 1 is inserted into an ear hole in the panel 3. At this time, the wearer previously turns OFF the power supply switch of the gain regulator 4 and inserts the case 3 into the ear hole by picking the case with his fingers, and then turns ON the gain regulator 4 and continues to adjust the same until the wearer can get a suitable volume of aid sound through an earphone (not shown) provided at the extreme end of the case 3.

On the other hand, when the hearing aid 1 is removed the ear hole, the power supply switch is returned to an OFF state and then the hearing aid 1 removed from the ear hole in such a manner that the taking-out knob 5 is lifted up and pulled by being picked with fingers.

Nevertheless, in the hearing aid 1 arranged as described above, since the gain regulator 4 with the switch is disposed on the panel independently of the taking-out knob 2, each time the wearer inserts or removes the hearing aid 1, he or she must turn ON or OFF the power supply to the gain regulator 4 with the switch to prevent the unnecessary consumption of a battery and in addition to that he or she must lift up or bring down the taking-out knob 4, and each time the wearer wears the hearing aid, he or she must controls a sound volume and these operations must be carried out in the narrow space around the ear hole by skillfully moving finger tips.

Conventionally, an ear insertion type hearing aid is devised so that it can be used inconspicuously in such a manner that a case containing a hearing aid signal processing circuit is inserted into the ear hole of a wearer and sound collected through a microphone mounted on a panel exposed to the periphery of the inlet of the ear hole is subjected to a hearing aid processing, as necessary, and then supplied to the interior of the ear hole as hearing aid sound through an earphone attached to the extreme end of the case.

This kind of the ear insertion type hearing aid may produce so-called howling in such a process that when the hearing aid is worn, hearing aid sound supplied to the interior of the external auditory miatus of a wearer from the earphone leaks out to the outside of the external auditory miatus through the gap between the case and the external auditory miatus wall of the wearer and returns again to the microphone.

This howling not only interrupts the function of the hearing aid but also makes the wearer very uncomfortable by the oscillating sound of high acoustic pressure.

As a method of preventing the occurrence of the gap, there is contemplated a method of making the outside diameter of the case at the portion thereof confronting the external auditory miatus of the wearer a little larger than the inside diameter of external auditory miatus of the wearer, but this method is disadvantageous in that it gives the wearer uncomfortableness and pain.

Conventionally, to solve this problem, there is a proposal for inserting a howling prevention band 14 around a case 13, as shown in FIG. 2.

The howling prevention band 14 is made of an annular elastic material and has three thin collars 14A, 14B and 14C formed around the outside periphery thereof.

An annular groove 12 is formed around the case 13 for positioning the howling prevention band 14 and the hearing aid 11 is worn in the state that the howling prevention band 14 is engaged with the groove 12.

According to this method, the howling prevention band 14 can prevent hearing aid sound supplied from an ear-phone from leaking through the gap between the case 13 and the external auditory miatus wall of a wearer to thereby avoid howling.

Neverthless, the conventional method has a drawback in that when the wearer removes the hearing aid 11 from the ear, the howling prevention band 14 is stretched by the friction between the howling prevention band 14 and an ear wall due to the elasticity thereof and removed from the groove 12 of the case 13 and remains in the ear hole.

SUMMARY OF THE INVENTION

In view of the foregoing, an object of this invention is to provide a hearing aid in which a time-consuming job required when a conventional hearing aid is inserted into and removed from an ear hole can be greatly reduced.

Another object of the invention is to provide a hearing aid in which can effectively avoid the possibility that when the hearing aid is removed from an ear hole, any component remains in the ear hole.

The foregoing objects and other objects of the invention have been achieved by the provision of a hearing aid 20 in which there are provided a case 21 inserted into an ear hole, a panel portion 23 attached to the case for closing the opening 22 thereof, a taking-out knob 29 to be turned to project from the panel portion 23 to an outside position for serving as a knob means when a wearer takes out the case 21 from the ear hole, a battery holder 27 holding a battery 28 and supported by the panel portion 23 to be able to turn within a battery accommodation window 24 provided with the panel portion 23, a cam means 29D turning together with the taking-out knob 29 and turning the battery holder 27 from a first turning position to a second turning position when the taking-out knob 29 is turned to the position where the taking-out knob 29 projects to the outside position of the panel portion 23, and a battery connecting means 25A and 25B electrically connected to the electrode 28A of the battery 28 when the battery holder 27 is at the first turning position and disconnected from the electrode 28A when the battery holder 27 is at the second turning position: and a hearing aid 20 which comprises a howling prevention fixture 45 attached to a hearing aid case 21 at the extreme end of the portion thereof confronting the external auditory miatus of a wearer to cause a connecting portion 48 projectingly formed at the extreme end of said hearing aid case 21 to pass therethrough and a fixing chip 47 for fixing said howling prevention fixture 45 to said hearing aid case 21 by being engaged with the extreme end of said connecting portion 48.

When the taking-out knob 29 capable of being freely brought down and lifted up attached to the panel portion 23 is lifted up to an outside position from the panel portion 23, a cam 29D turning together with the taking-out knob 29 causes the battery holder 27 to turn from the first turning position to the second turning position, and when the battery holder 27 is at the second turning position, a power supply can be cut off.

With this arrangement, when the hearing aid 20 is taken out from an ear hole, the power supply is simultaneously turned ON or OFF, whereby a time-consuming job required for a wearer to insert and remove the hearing aid can be further saved.

A howling prevention fixture 45 is attached to a hearing aid case 21 at the extreme end of the portion thereof confronting the external auditory miatus of a wearer to cause a connecting portion 48 projectingly formed at the extreme end of the hearing aid case 21 to pass therethrough, and a fixing chip 47 is engaged with the connecting portion 48 passing through the howling prevention fixture 45 to hereby fix the howling prevention fixture 45 to the hearing aid case 21, whereby the howling prevention fixture 45 is difficult to be removed from the hearing aid case 21 and thus the drawback that the howling prevention fixture 45 remains in the ear hole of the wearer can be effectively avoided.

The nature, principle and utility of the invention will become more apparent from the following detailed description when read in conjunction with the accompanying drawings in which like parts are designated by like reference numerals or characters.

DETAILED DESCRIPTION OF THE INVENTION

Preferred embodiments of this invention will be described with reference to the accompanying drawings:

In FIGS. 3 to 7, 20 designates a hearing aid as a whole, and a case 21 has a gently curved surface tapered toward the extreme end thereof, so that when the hearing aid is inserted into the ear hole of a wearer, the hearing aid fits to an external auditory miatus.

Figure 4:
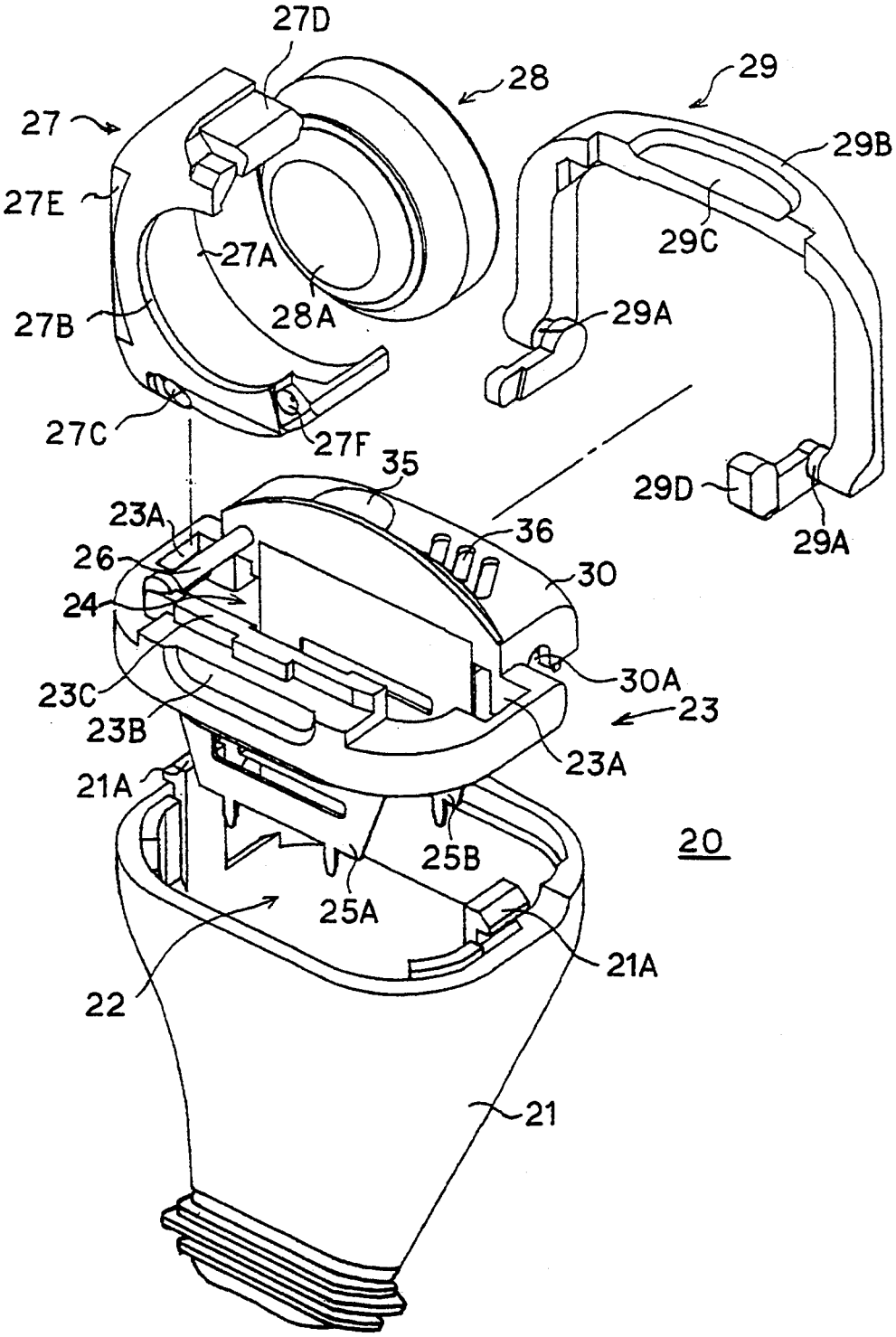
FIG. 4 is an exploded structural view showing a hearing aid according to the present invention as a whole.

A substantially rectangular opening 22 is defined on the upper end of the case 21 as shown in FIG. 4 and a plate-shaped panel portion 23 is disposed to close the opening 22. This embodiment is provided with a pair of fasteners 21A projecting upward from the shorter sides extending in the forward and backward directions at the right and left positions of the periphery of the opening 22. The fasteners 21A are engaged with cutouts 23A defined to the panel portion 23 to enable the panel portion 23 to be integrally fixed to the case 21.

A battery accommodation window 24 defined at the center of the panel portion 23 passes through the thickness direction of the panel portion 23 and laterally extends in the right and left directions, and battery connecting tongues 25A and 25B are fixed to the battery accommodation window 24 in such a manner that they project downward in confrontation with the front and rear side walls of the battery accommodation window 24.

A battery holder support shaft 26 extending in the forward and backward directions to stride across the battery accommodation window 24 is attached to the left side position of the battery accommodation window 24 and a battery holder 27 is turningly supported by the battery holder support shaft 26.

The battery holder 27 is composed of a frame member having a C-shaped longitudinal cross section in the right and left directions, and the inside surface 27A thereof forms an arc-shaped surface which has a radius fitting to the outside surface of a disc-shaped button type battery 28, and thus when the battery 28 is inserted into the inside surface 27A from the backside, the battery 28 is held in the battery holder 27 in the state that an electrode 28A formed to expose to the front and back side of the battery 28 is exposed in the forward and backward directions through the front and back openings 27B of the battery holder 27.

A shaft receiving cutout 27C extending in the forward and backward directions is formed to the outside surface of the battery holder 27, and when the battery holder support shaft 26 is engaged with the shaft receiving cutout 27C, the battery holder 27 is turningly supported about the battery holder support shaft 26.

As a result, when the battery holder 27 is turned to the upper turning position in the counterclockwise direction when view from the front (FIG. 4), the battery holder 27 is pulled out upwardly of the battery accommodation window 24 as a whole, and at this time the battery 28 can be mounted to and removed from the battery holder 27.

Figure 6:
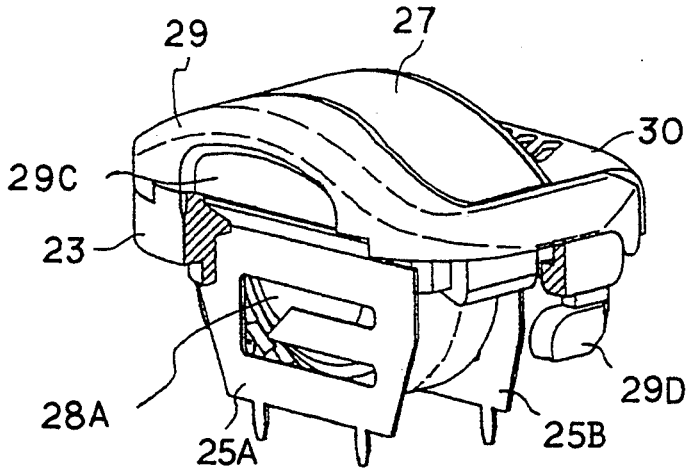
FIG. 6 is a partial cross sectional view showing the upper portion of a hearing aid according to the present invention when the hearing aid is worn.

When the battery holder 27 turned from the upper turning position to the lower turning position in the clockwise direction, as shown in FIG. 6, the battery holder 27 is pushed into the interior of the battery accommodation window 24 as a whole, and the battery connecting tongues 25A and 25B come into contact with the electrode 28A of the battery 28 held by the battery holder 27 at this time, whereby the battery 28 is electrically connected to a hearing aid signal processing circuit (not shown) contained in an electronic component accommodation chamber 30 disposed on the backside of the battery accommodation window 24 in contact therewith, through the battery connecting tongues 25A and 25B.

Figure 5:
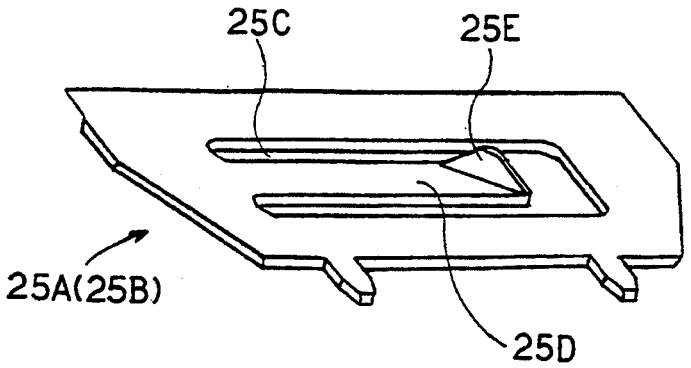
FIG. 5 is a perspective view of a battery connecting tongue attached to a panel portion according to the present invention.

As shown in FIG. 5, in this embodiment, a terminal 25D is formed by a C-shaped cutout 25C in the right and left direction at the center of each of the battery connecting tongues 25A and 25B, and when the battery holder 27 is turned to the lower turning position, the extreme end bent contacts 25E of the confronting terminals 25D sandwich the electrode 28A of the battery 28 and come into contact therewith.

Further, when the battery holder 27 is turned to the lower turning position, the battery accommodation window 24 is closed by the outside surface of the battery holder 27 and thus the outside surface acts as a battery cover.

Figure 7:
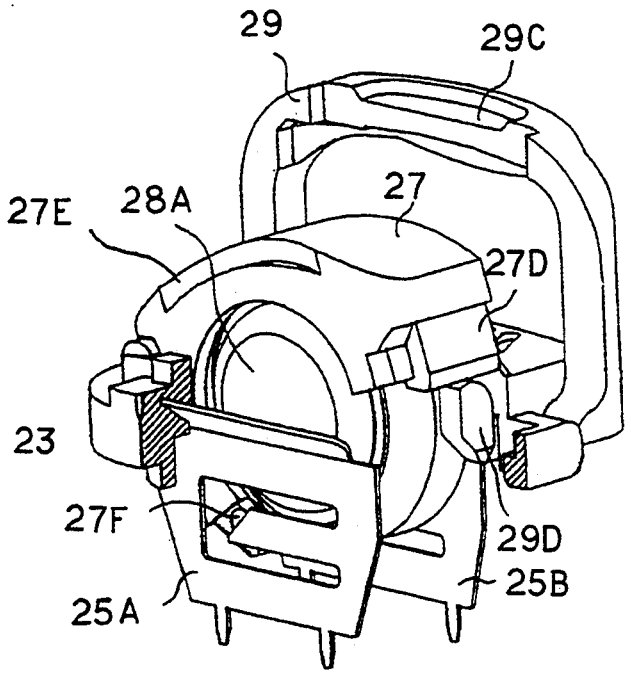
FIG. 7 is a partial cross sectional view showing the upper portion of a hearing aid according to the present invention when the hearing aid is removed.

In the addition to the above, when the battery holder 27 is slightly turned counterclockwise from the lower turning position and located at an intermediate turning position as shown in FIG. 7, the battery connecting tongues 25A and 25B cannot come into contact with the electrode 28A of the battery 28 held by the battery holder 27, and thus the battery 28 is disconnected from the hearing aid signal processing circuit.

In addition to the above arrangement, a C-shaped taking-out knob 29 capable of being freely brought down and lifted up is attached to the panel portion 23. The taking-out knob 29 has turning shafts 29A projecting inward at the right and left opposite ends thereof and the turning shafts 29A are engaged with the shaft receiving cutouts 30A defined to the right and left side walls of the electric circuit chamber 30, whereby the taking-out knob 29 can be turned in the forward and backward directions about the shaft receiving cutouts 30A.

The central portion extending to the right and left directions of the taking-out knob 29 forms a grip portion 29B to be actuated by the fingers of a wearer. When the taking-out knob 29 is brought down in the forward direction, the taking-out knob 29 is folded to a small size by lying on the front edge of the panel portion 23 as shown in FIG. 6, and when the taking-out knob 29 is lifted up in the backward direction, it is projected outwardly of the panel portion 23 as shown in FIG. 7, and thus the wearer can easily pull out the taking-out knob 29 by picking the grip portion 29B with fingers.

In the case of this embodiment, a crescent-shaped actuation groove 29C is formed to the front surface of the grip portion 29B, and thus when the taking-out knob 29 lies on the panel portion 23, the wearer can easily puts a finger in the actuation groove 29C when the wearer lifts up the taking-out knob 29 together with the crescent-shaped actuation groove 23B formed to the front surface of the panel portion 23.

An L-shaped cam 29D is fixed to, for example, the turning shaft 29A on the right side of the taking-out knob 29 at an angle of 90° therewith so that the cam 29D can be turned together with the turning shaft 29A. Therefore, when the taking-out knob 29 is brought down to the lower turning position (FIG. 6), the extreme end of the cam 29D is projected forward, and thus the cam 29D is spaced apart from a locking piece 27D provided with the side end in the clock-wise direction of the battery holder 27 and extends in a direction substantially parallel therewith. As a result, the battery holder 27 can be at the lower turning position without being regulated by the cam 29D.

When, however, the taking-out knob 29 is lifted up outwardly of the panel portion 23 in this state (FIG. 7), the cam 29D is turned in the direction for extending the extreme end thereof upward and abutted against the locking piece 27D of the battery holder 27 to thereby push the locking piece 27D upward. As a result, the battery holder 27 is turned counterclockwise to an intermediate turning position.

In the case of this embodiment, a semi-spherical locking hole 27F is defined to the front surface of the side end in the counterclockwise direction of the battery holder 27, and when the battery holder 27 is at the intermediate turning position (FIG. 7), the extreme end bent contact the terminal 25D on the front side is elastically engaged with the locking hole 27F, so that the battery holder 27 can be locked at the intermediated turning position for click operation.

Further, sound holes 36 for gathering external sound to a microphone (not shown) and a semi-adjustable type gain regulator 35 dedicated for regulating a sound volume are provided on the upper surface of the electronic components accommodation chamber 30. The semi-adjustable type gain regulator 35 is preselected to obtain a suitable level of hearing sound to eliminate the time-consuming job that a wearer must regulate a gain each time he or she wears a hearing aid.

Figure 3:
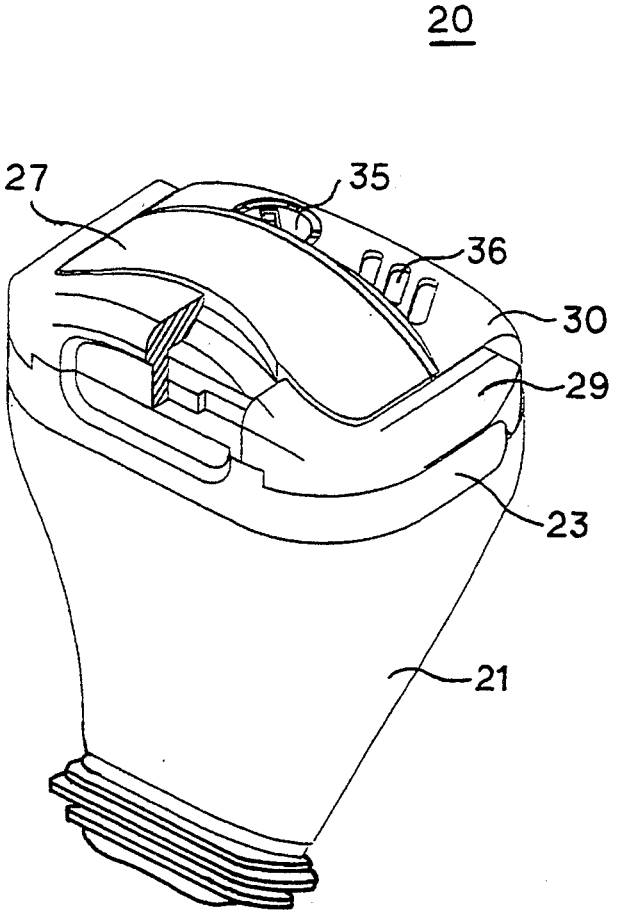
FIG. 3 is a perspective view of a hearing aid according to the present invention.

In the above arrangement, when a wearer wears the hearing aid 20, the taking-out knob 29 is brought down forward and the battery holder 27 is turned to the lower turning position, as shown in FIGS. 3 and 6. At this time, the extreme end bent contacts 25E of the battery connecting tongues 25A and 25B come into contact with the electrode 28A of the battery 28 held by the battery holder 27 to supply an electric power to the hearing aid signal processing circuit. At this time, the inside surface of the grip portion 29B of the taking-out knob 29 is locked to a locking piece 23C formed on the front edge of the panel portion 23, and locking groove 27E of the battery holder 27 to thereby maintain the turned state of the battery holder 27 and the taking-out knob 29.

With this arrangement, the hearing aid 20 is in an operating state as a whole and thus a wearer can hear hearing aid sound regulated to a present suitable sound level by inserting the hearing aid into his or her ear hole.

When the wearer takes out the hearing aid 20 from the ear hole in this operating state, he or she lifts up the taking-out knob 29 with a finger put into the operation groove 29C formed to the grip portion 29B of the taking-out knob 29.

At this time, the L-shaped cam 29D of the taking-out knob 29 pushes up the locking piece 27D of the battery holder 27 to thereby turn the battery holder 27 to the intermediate turning position (FIG. 7). When the battery holder 27 is turned to the intermediate turning position, the extreme end bent contacts 25E of the battery connecting tongues 25A and 25B leave the electrode 28A of the battery 28 to lock the locking hole 27F of the battery holder 27, with the result that the hearing aid 20 is disconnected from the power supply as a whole.

According to the above arrangement, a wearer can remove the hearing aid 20 disconnected from the power supply only by that he or she lifts up the taking-out knob 29 and takes out the same from an ear hole by picking the taking-out knob 29 with fingers. Therefore, a compact hearing aid can be easily realized which does not need a gain regulator provided with a power supply switch and is continuously operable with a suitable level of hearing aid sound once this level is regulated to the suitable level.

The battery 28 in the battery holder 27 can be easily replaced by a wearer in such a simple manner that he or she turns the battery holder 27 of the hearing aid 20 removed from an ear hole from the intermediate turning position to the Upper turning position.

Note, although the L-shaped cam is used as the cam 29 fixed to the taking-out knob 29 in the aforesaid embodiment shown in FIGS. 3 to 7, the present invention is not limited thereto and a cam means of various arrangements which pushes up the battery holder 27 in association with the taking-out knob 29 can be applied to the present invention.

Further, although the turning shaft 29A of the taking-out knob 29 is turned by being locked to the shaft receiving cutouts 30A passing through the right and left side walls of the electric circuit chamber 30 in the aforesaid embodiment shown in FIGS. 3 to 7, the present invention is not limited thereto and the taking-out knob 29 may be turned by being locked to shaft receiving cutouts defined to the right and left side walls of the case 21 or panel portion 23.

Further, the battery connecting tongues 25A and 25B are disposed on the front and back side walls of the battery accommodation window 24 as the power supply terminals in the aforesaid embodiment shown in FIGS. 3 to 7, the present invention is not limited thereto and any other device may be used so long as it can switch the power supply depending upon the positional change of the battery 28.

Further, the semi-adjustable type gain regulator 35 is used as the gain regulator 35 in the aforesaid embodiment shown in FIGS. 3 to 7, the present invention is not limited thereto and a gain regulator other than the semi-adjustable type may be applied to the present invention.

In FIGS. 8 to 11, 21A designates the cross section of a case 21. A connecting portion 48 to be connected to a fixing chip 47 is formed at the extreme end of the case 21 and projects outward.

Figure 9:
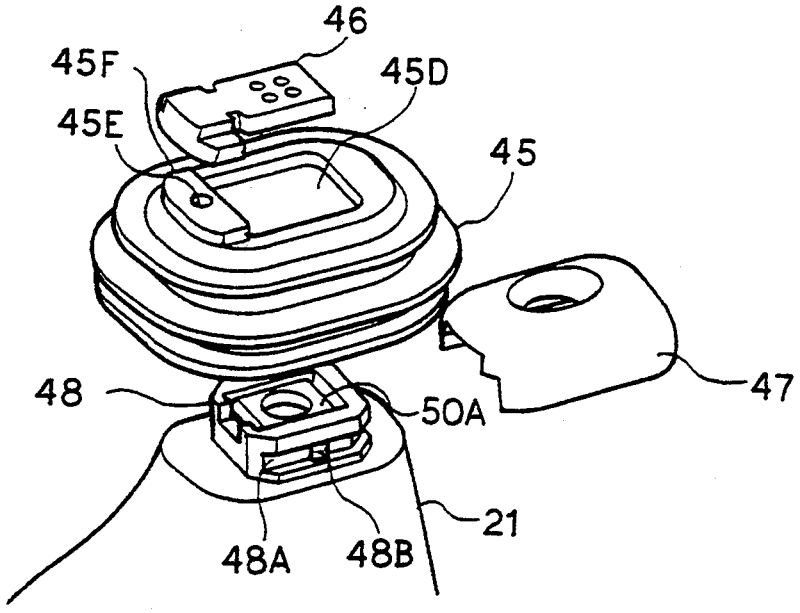
FIGS. 9 to 11 are exploded perspective views showing the structure of the extreme end of the hearing aid of FIG. 8.

As shown in FIG. 9, the connecting portion 48 is formed to a column shape as a whole and a groove 48A is formed in the range covering the front, right and back sides of the connecting portion 48 in FIG. 9 and serves as a guideline when the connecting portion 48 is slidingly connected to the fixing chip 47 (as described below).

Figure 8:
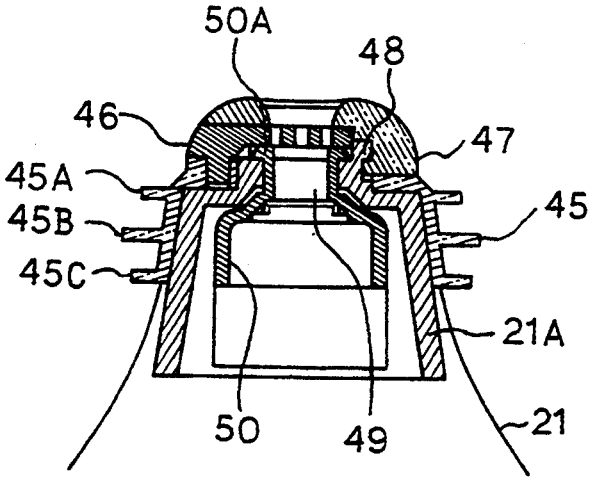
FIG. 8 is a partial cross section view showing an extreme end of a case.

As shown in FIG. 8, an empty portion is defined at the center of the connecting portion 48 and an earphone tube 50 is provided to pass through the empty portion, and thus an earphone 49 is held in such a manner that the earphone tube 50 is gripped by the connecting portion 48 through a claw portion 50A formed at the extreme end of the earphone tube 50.

A howling prevention fixture 45 is attached to the extreme end of the case 21.

The howling prevention fixture 45 is made of a flexible material such as, for example, silicone rubber or the like and selected to have a tapered hat-shape so that it can be in intimate contact with the extreme end of the case 21 as a whole.

As shown in FIG. 9, an opening 45D is defined at the center of the head portion of the howling prevention fixture 45 to enable the connecting portion 48 to pass therethrough, and a step 45F is formed on the left side of the opening 45D and a circular hole 45E is defined at the center of the upper surface of the step 45F, respectively.

Further, three thin collars 45A, 45B and 45C are outwardly projectingly formed around the outside periphery of the howling prevention fixture 45, for example, substantially at the same interval.

The collars 45A and 45C are formed on the both sides of a side wall in the circumferential direction thereof and the collar 45B formed therebetween has an outside diameter slightly larger than that of the collars 45A and 45C.

An earwax invasion preventing chip 46 is inserted into the hollow formed by the claw portion 50A exposed from the extreme end of the above connecting portion 48 and the inside wall of the connecting portion 48. Further, a column-shaped projection 46A formed on the lower surface of the earwax invasion preventing chip 46 shown in FIG. 10 is engaged with the hole 45E defined to the head portion of the above howling prevention fixture 45, so that they are arranged as an integral member.

Figure 11:
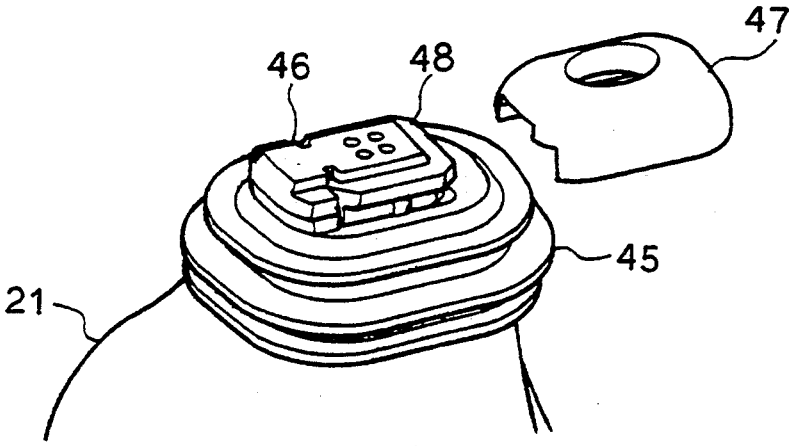

FIG. 11 shows the state that the howling prevention fixture 45 and the earwax invasion preventing fixture 46 are accommodated in the case 21, and thereafter the fixing chip 47 is slidingly connected to the connecting portion 48 to thereby cause the howling prevention fixture 45 and the earwax invasion preventing fixture 46 to be integrally fixed in the case 21.

Figure 10:
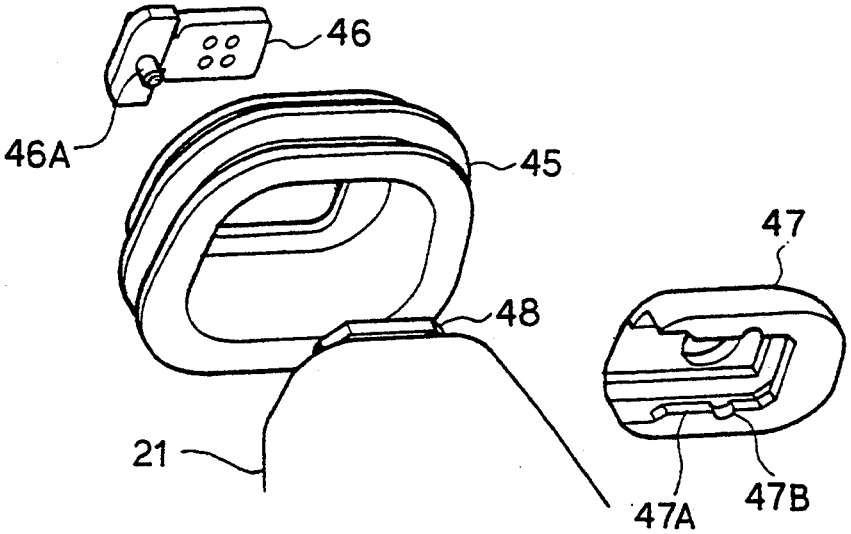

By the way, as shown in FIG. 10, a pair of projections 47A are formed on the both surfaces of the inside wall of the fixing chip 47 and slid into the groove 48A formed on the side wall of the above connecting portion 48 to cause the fixing chip 47 to be slidingly connected to the connecting portion 48.

Note, at this time, the juts 48B formed in the middle of the groove 48A (FIG. 9) are engaged with the recesses 47B formed in the middle of the projections 47A to prevent the fixing chip 47 from being easily removed from the connecting portion 48.

In the above arrangement shown in FIG. 8 to 11, when the hearing aid in use is removed from an ear hole, a force in the direction of the fixing chip 47 is applied to the collars 45A, 45B and 45C formed on the side walls of the howling prevention fixture 45 by the friction between an ear wall and these collars and thus the howling prevention fixture 45 is subjected to a force similar to that applied thereto when the howling prevention fixture 45 is pulled in the upward direction in FIG. 8. However, the howling prevention fixture 45 is not removed from the case 21 because it is fixed to the case 21 at the head portion thereof by the fixing chip 47, whereby the drawback that the howling prevention fixture 45 remains in the ear hole of a wearer can be effectively avoided.

According to the above arrangement, howling is prevented by the simple structure that the howling prevention fixture 45 is fixed to the case 21 by the fixing chip 47 and further the howling prevention fixture 45 is prevented from being easily removed from the case 21, whereby a wearer can use the hearing aid more conveniently.

Further, the howling prevention fixture 45, earwax invasion preventing fixture 46 and the like which are liable to be polluted by a secretion secreted from the an external auditory miatus can be easily cleaned and replaced, and thus a good sanitary state can be easily maintained.

Note, although the howling prevention fixture 45 has the three collars and the outside diameter of the collar 45B at the center is slightly larger than that of the collars 45A and 45B on the both sides in the above embodiment, the present invention is not limited thereto and any number of collars may be employed or all collars may have the same diameter so long as they can effectively prevent the leakage of sound.

Further, although the above embodiment describes the case in which the collars are formed around the side wall of the howling prevention fixture 45, the present invention is not limited thereto and not collar is formed around the side wall of the howling prevention fixture 45 and the side wall may be made thicker. In short, any arrangement may be employed so long as it can effectively prevent the leakage of sound.

Further, although the above embodiment describes the case in which the fixing chip 47 is slidingly connected to the connecting portion 48 from one direction, the present invention is not limited thereto and the fixing chip may be divided into two parts which are slidingly connected to the connecting portion 48 from the confronting opposite sides.

Further, although the above embodiment describes the case in which the groove 48A is formed to have the C-shaped cross section, the present invention is not limited thereto and the groove 48A may be tapered so that the depth thereof is made shallow toward the extreme end of the connecting portion 48. In short, the groove may be formed to any shape so long as the connecting portion 48 is slidingly connected to the fixing chip 47 through the groove.

Further, although the above embodiment describes the case in which the fixing chip 47 is slidingly connected to the connecting portion 48, the present invention is not limited thereto and the fixing chip 47 may be engaged with the connecting portion 48. In short, the fixing chip 47 may be formed to any shape so long as it can be easily removed from the connecting portion 48 when a wearer takes out the hearing aid 20 from an ear hole.

Figure 1:
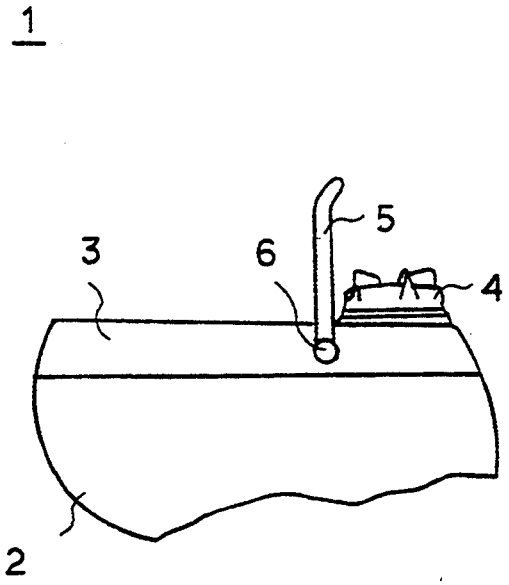
FIG. 1 (PRIOR ART)
FIG. 1 is a schematic view of a conventional ear insertion type hearing aid.
Figure 2:
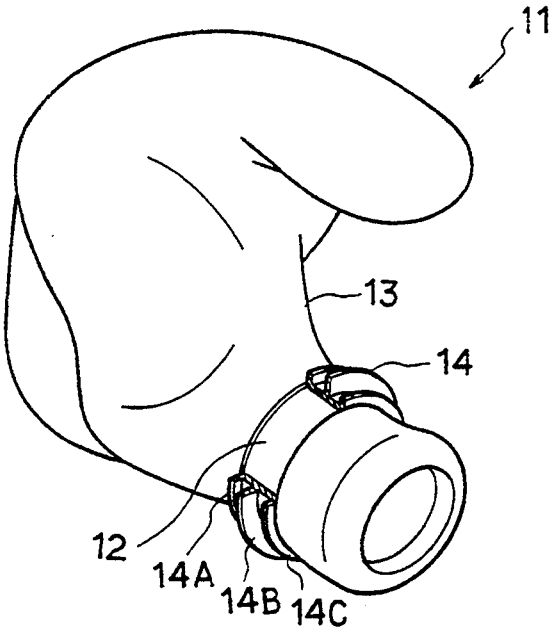
FIG. 2 (PRIOR ART)
FIG. 2 is a perspective view showing the mounting structure of a conventional howling prevention fixture.
Figure 12:
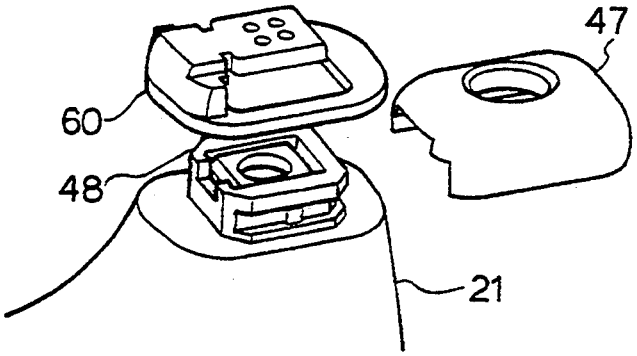
FIG. 12 is a exploded perspective view showing another embodiment.

Further, although the above embodiment describes the case in which the howling prevention fixture 45 is used, the present invention is not limited thereto and when the howling prevention fixture 45 is not needed, an earwax invasion preventing chip 60 integrally composed of the head portion of the howling prevention fixture 45 and the earwax invasion preventing chip 45 may be employed, as shown in FIG. 12.

As described above, according to the present invention, since the power supply switch is turned 0N and OFF by the turning movement of the taking-out knob, a compact hearing aid can be obtained which can be operated more easily than a conventional hearing aid including a gain controller provided with a switch.

Further, the howling prevention fixture is attached to the hearing aid case at the extreme end of the portion thereof confronting the external auditory miatus of a wearer and fixed to the case main body of the hearing aid by the fixing chip, and thus when the hearing aid is removed from an ear hole, any component of the hearing aid can be effectively prevented from remaining in the ear hole.

While there has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A hearing aid, comprising:

a case for inserting into an ear hole;

a panel portion attached to said case for closing an opening thereof;

a taking-out knob to be turned to project from said panel portion to an outside position for serving as a knob means when a wearer takes out said case from said ear hole;

a battery holder holding a battery and supported by said panel portion to be able to turn within a battery accommodation window provided with said panel portion;

a cam means turning together with said taking-out knob and turning said battery holder from a first turning position to a second turning position when said taking-out knob is turned to the position where said taking-out knob projects to said outside position; and a battery connecting means electrically connected to electrodes of said battery when said battery holder is at the first turning position and disconnected from said electrodes when said battery holder is at the second turning position.

2. The hearing aid according to claim 1, wherein said battery holder is composed of a frame member having a C-shaped longitudinal cross section which has a radius fitting to the outside surface of a raid battery.

3. The hearing aid according to claim 2, wherein said battery to be held in said battery holder is a disc-shape button type battery with said electrodes on both side surfaces.

4. The hearing aid according to claim 3, wherein said battery holder has a shaft receiving cutout formed to the upper portion of said battery holder, said shaft receiving cutout being engaged with a holder support shaft, so that when said battery holder is turned to said second turning position, said battery holder is pulled out of said panel portion as a whole.

5. The hearing aid according to claim 4, wherein when said battery holder is turned to said first turning position, said electrodes of said battery come into contact with battery connecting tongues, and when said battery holder is turned to said second turning position, said electrodes of said battery come into discontact from said battery connecting tongues.

6. A hearing aid comprising:

a case for inserting into an ear hole;

a panel portion attached to said case for closing an opening thereof;

a taking-out knob to be turned to project from said panel portion to an outside position for serving as a knob means when a wearer takes out said case from said ear hole;

a battery holder holding a battery and supported by said panel portion to be able to turn within a battery accommodation window provided within said panel portion;

a cam means turning together with said taking-out knob and turning said battery holder from a first turning position to a second turning position when said taking-out knob is turned to project to said outside position;

a battery connecting means electrically connected to the electrodes of said battery when said battery holder is at the first turning position and disconnected from said electrodes when said battery holder is at the second turning position;

a howling prevention fixture accommodated on said case at an extreme end of said case confronting the external auditory meatus of a wearer to allow a connecting portion projectingly formed at the extreme end of said case to pass therethrough; and a fixing chip for internally securing said howling prevention fixture to said case by being slidably engaged with the extreme end of said connection portion.

7. The hearing aid according to claim 6, wherein said howling prevention fixture has a tapered hat-shape portion having a plurality of collars which are outwardly projectingly formed around the outside periphery thereof.

8. The hearing aid according to claim 6, wherein said fixing chip secures both said howling prevention fixture and an earwax invasion preventing fixture to said hearing aid case.

* * * * *